US009375083B2

(12) United States Patent
Haemmerle et al.

(10) Patent No.: US 9,375,083 B2
(45) Date of Patent: Jun. 28, 2016

(54) EJECTION DEVICE FOR A MOVABLE FURNITURE PART

(71) Applicant: Julius Blum GmbH, Hoechest (AT)

(72) Inventors: Hermann Haemmerle, Lustenau (AT); Katharina Schuller, Lochau (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 14/563,160

(22) Filed: Dec. 8, 2014

(65) Prior Publication Data

US 2015/0091427 A1 Apr. 2, 2015

Related U.S. Application Data

(63) Continuation of application No. PCT/AT2013/000089, filed on May 17, 2013.

(30) Foreign Application Priority Data

Jul. 10, 2012 (AT) ..... A 768/2012

(51) Int. Cl.
*A47B 95/00* (2006.01)
*A47B 88/04* (2006.01)

(52) U.S. Cl.
CPC ..... *A47B 88/04* (2013.01); *A47B 88/0477* (2013.01); *A47B 2210/0086* (2013.01)

(58) Field of Classification Search
CPC ..... A47B 88/047; A47B 88/0477; A47B 88/0481
USPC ..... 312/333, 319.1, 334.1, 334.2, 334.7, 312/334.8
See application file for complete search history.

(56) References Cited

U.S. PATENT DOCUMENTS 5,498,039 A 3/1996 Bivens
7,210,198 B2 * 5/2007 Hoshide et al. ..... 16/96 R
(Continued)

FOREIGN PATENT DOCUMENTS

AT 511 329 11/2012
CN 2648909 10/2004
(Continued)

OTHER PUBLICATIONS

International Search Report (ISR) issued Dec. 6, 2013 in International (PCT) Application No. PCT/AT2013/000089.
(Continued)

*Primary Examiner* — Daniel J Troy
*Assistant Examiner* — Kimberley S Wright
(74) *Attorney, Agent, or Firm* — Wenderoth, Lind & Ponack, L.L.P.

(57) ABSTRACT

A lockable ejection device for a movable furniture part includes an ejection element acting on the movable furniture part in an opening direction, a housing, and a locking element arranged in or on the housing. At least in the closing direction of the movable furniture part, the path of the ejection element in the opening direction can be blocked by the locking element. Both when excess pressure is applied to the movable furniture part from a closed position in the closing direction and when the movable furniture part is pulled from the closed position in the opening direction, the ejection element can be released by the locking element. Both when excess pressure is applied to the movable furniture part and when the movable furniture part is being pulled, the ejection element can be unlocked by a movement of the locking element relative to the housing.

13 Claims, 14 Drawing Sheets

(56) References Cited

U.S. PATENT DOCUMENTS

| | | | | |
|---|---|---|---|---|
| 7,244,005 | B1 * | 7/2007 | Lu | 312/333 |
| 7,347,515 | B1 * | 3/2008 | Lu | 312/333 |
| 7,374,261 | B1 * | 5/2008 | Wang | 312/333 |
| 7,413,270 | B2 * | 8/2008 | Chang et al. | 312/333 |
| 7,914,093 | B2 * | 3/2011 | Huang | A47B 88/0477 312/319.1 |
| 8,079,653 | B2 * | 12/2011 | Huang | 312/333 |
| 8,083,304 | B2 * | 12/2011 | Hu | A47B 88/047 312/319.1 |
| 8,256,853 | B2 * | 9/2012 | Chen et al. | 312/333 |
| 8,496,306 | B2 * | 7/2013 | Chen | A47B 88/0477 312/319.1 |
| 8,534,781 | B2 * | 9/2013 | Netzer et al. | A47B 88/0477 312/319.1 |
| 8,556,305 | B2 * | 10/2013 | Juan et al. | 292/164 |
| 8,668,288 | B2 * | 3/2014 | Salice | 312/333 |
| 8,721,011 | B2 * | 5/2014 | Salice | 312/333 |
| 8,783,799 | B2 * | 7/2014 | Chen | 312/333 |
| 8,801,120 | B2 * | 8/2014 | Chen | A47B 88/0481 312/333 |
| 8,888,200 | B2 * | 11/2014 | Sato | E05F 5/003 312/319.1 |
| 8,899,703 | B2 * | 12/2014 | Chung | 312/333 |
| 8,911,038 | B2 * | 12/2014 | Gmeiner | 312/331 |
| 8,939,525 | B1 * | 1/2015 | Chen | A47B 88/047 312/333 |
| 9,215,929 | B2 * | 12/2015 | Brunnmayr | A47B 88/0477 |
| 2005/0093406 | A1 * | 5/2005 | Yang | 312/333 |
| 2007/0090735 | A1 | 4/2007 | Hashemi et al. | |
| 2008/0061663 | A1 * | 3/2008 | Wu | A47B 88/047 312/333 |
| 2008/0136300 | A1 * | 6/2008 | Wang | 312/319.1 |
| 2008/0169741 | A1 * | 7/2008 | Jurja | 312/319.1 |
| 2008/0191592 | A1 * | 8/2008 | Dubach | A47B 88/0477 312/319.1 |
| 2009/0072687 | A1 * | 3/2009 | Fitz | A47B 88/0477 312/319.5 |
| 2009/0079205 | A1 | 3/2009 | Nishida | |
| 2009/0284114 | A1 * | 11/2009 | Fitz | A47B 88/0477 312/319.5 |
| 2010/0026152 | A1 * | 2/2010 | Huang | A47B 88/0477 312/319.1 |
| 2010/0327719 | A1 | 12/2010 | Koenig et al. | |
| 2011/0210653 | A1 * | 9/2011 | Salice | 312/319.1 |
| 2011/0235952 | A1 * | 9/2011 | Chen | F16C 29/02 384/7 |
| 2011/0254416 | A1 * | 10/2011 | Salice | 312/319.1 |
| 2012/0001441 | A1 * | 1/2012 | Juan et al. | 292/164 |
| 2012/0038255 | A1 * | 2/2012 | Netzer | A47B 88/0477 312/319.1 |
| 2013/0004101 | A1 * | 1/2013 | Chen | A47B 88/0477 384/10 |
| 2013/0134852 | A1 * | 5/2013 | Salice | 312/319.1 |
| 2013/0187524 | A1 * | 7/2013 | Chen | 312/319.1 |
| 2013/0257245 | A1 * | 10/2013 | Gmeiner | 312/319.1 |
| 2013/0287324 | A1 * | 10/2013 | Nuckolls | 384/18 |
| 2014/0021841 | A1 * | 1/2014 | Brunnmayr | 312/319.1 |
| 2014/0312755 | A1 * | 10/2014 | Nuckolls | 312/333 |
| 2014/0327351 | A1 * | 11/2014 | Chung | 312/333 |
| 2014/0352109 | A1 * | 12/2014 | Chen | 16/90 |
| 2015/0091424 | A1 * | 4/2015 | Nuckolls | 312/319.1 |

FOREIGN PATENT DOCUMENTS

| | | | |
|---|---|---|---|
| DE | 195 14 154 | | 11/1995 |
| DE | 10 2010 036 902 | | 2/2011 |
| DE | 202010013193 | * | 3/2012 |
| EP | 2 272 400 | | 1/2011 |
| EP | 2 294 944 | | 3/2011 |
| EP | 2 364 614 | | 9/2011 |
| JP | 2007-9507 | | 1/2007 |
| JP | 2008-208684 | | 9/2008 |
| WO | 2007/050737 | | 5/2007 |
| WO | 2009/114887 | | 9/2009 |
| WO | 2011/015663 | | 2/2011 |

OTHER PUBLICATIONS

Austrian Patent Office Search Report (ASR) issued Mar. 14, 2013 in Austrian Patent Application No. A 768/2012.

Chinese Office Action issued Mar. 14, 2016 in corresponding Chinese Application No. 201380036578.6.

* cited by examiner 20
5
2
21
23
18
19
1
SS
24
3
22=4
8+6=7

2
ÜS
SR
4
3
5
8
23

2
ZS
OR
4
3
5

OS
OR
24
3
6
21
23
2

Fig.16 SS
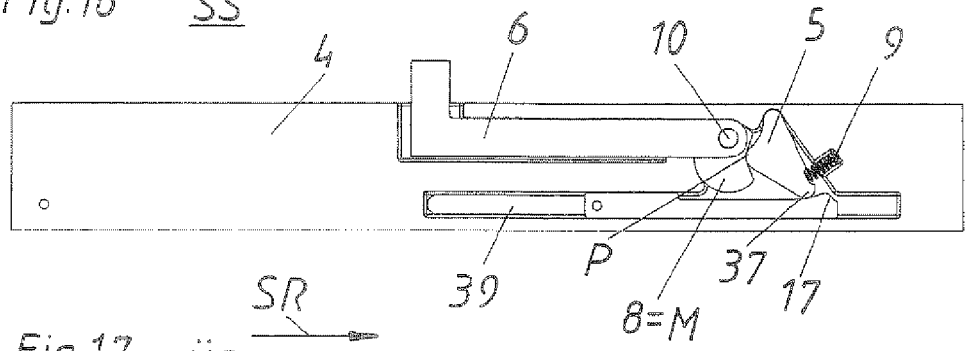
Fig.17 ÜS
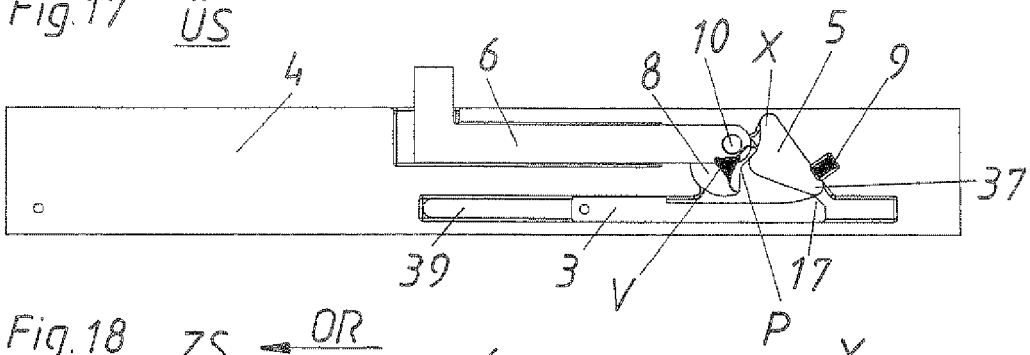
Fig.18 ZS
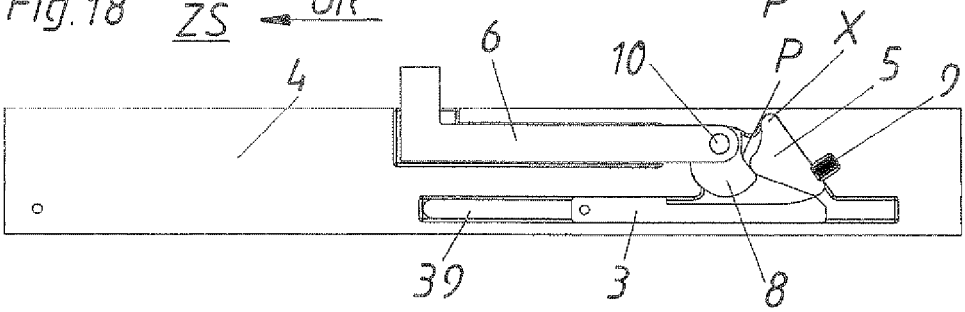
Fig.19 OS
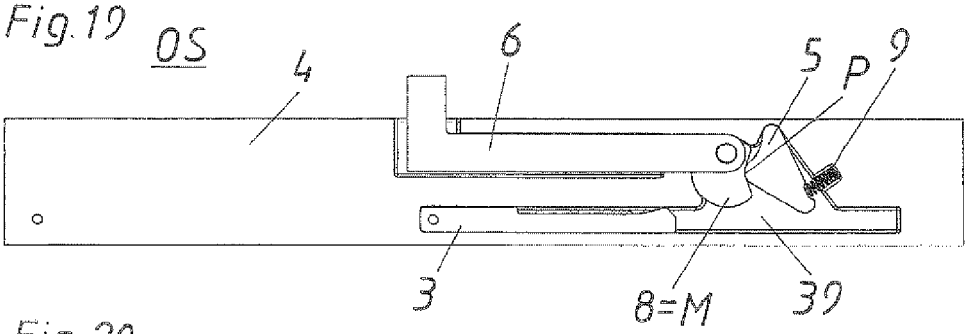
Fig.20 SS
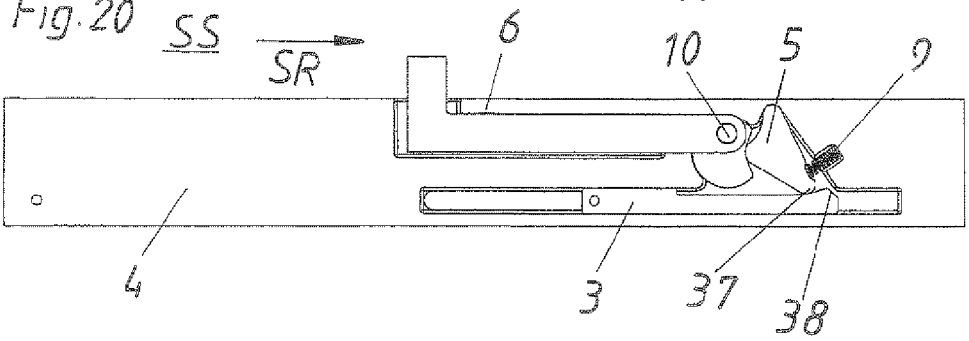

EJECTION DEVICE FOR A MOVABLE FURNITURE PART

BACKGROUND OF THE INVENTION

The invention concerns a lockable ejection device for a moveable furniture part, comprising an ejection element which acts on the moveable furniture part in the opening direction, a housing, and a locking element which is arranged in or on the housing and by which the path of the ejection element in the opening direction can be blocked at least in the closed position of the moveable furniture part. Both upon over-pressing of the moveable furniture part from a closed position in the closing direction and also upon pulling of the moveable furniture part from the closed position in the opening direction the ejection element can be released by the locking element. In addition, the invention concerns an article of furniture having such a lockable ejection device.

Ejection devices have already been known for many years in the field of furniture fittings, by which a moveable furniture part is automatically opened. The user only has to push against the moveable furniture part so that the locking action is released and the moveable furniture part is ejected by a force storage means.

A commonly used variant for locking the ejection device is locking by way of a cardioid curve. In that case, a latching element connected to the ejection element is held in the closed position in a recess in a cardioidcurve-shaped sliding track. By pushing against the moveable furniture part, the latching element is moved out of the recess whereby the path for movement into an opening portion of the cardioid curve-shaped sliding track is clear.

A problem with such lockable ejection devices with a cardioid curve-shaped sliding track is that it can be opened only by pushing. If, however, the furniture part is pulled, no opening can take place as the latching element cannot escape from the latching recess of the cardioid curve-shaped sliding track.

Numerous arrangements are already known for resolving that problem, in which unlocking is effected not only by pushing but also by pulling. EP 2 272 400 A1, JP 2007-009 507, U.S. Pat. No. 7,374,261 and JP 2008-208 684 disclose examples in that respect, in which parts of the cardioid curve-shaped sliding track are rotated or pivoted when a pulling force is applied so that unlocking is also possible when pulling on the latching element.

WO 2007/050737 A2 discloses a flexible spreadable passage through which the latching element can issue in the opening direction and can thus release the locking action, when a pulling force is used.

Austrian application A 614/2011 (which is not a prior publication and which forms a prior right) discloses a displaceable "plug member" forming the latching recess of the cardioid-shaped sliding track. When pulling on the locked latching element, that "plug member" is moved against a spring and an overload path of travel is cleared for the latching element.

SUMMARY OF THE INVENTION

Now, the object of the present invention is to provide a lockable ejection device as an alternative to the state of the art. In particular, the invention seeks to make it possible in a simple fashion for the ejection device to be unlocked both upon over-pressing and also upon pulling.

According to the invention, the ejection element can be unlocked by a relative movement of the locking element relative to the housing both upon over-pressing of the moveable furniture part and also upon pulling of the moveable furniture part. The particular advantage in this respect is that the same movement of the locking element is always involved upon over-pressing and upon pulling. In the case of the lockable ejection devices known in the state of the art, the latching recess always forms the locking element. That latching recess, however, is not moved in the normal opening movement by over-pressing. It is only upon pulling that a movement of at least a part of the latching recess is implemented in the ejection devices in accordance with the state of the art.

In a preferred embodiment of the present invention, the ejection device includes a detection device for detecting the position of the moveable furniture part, and a transmission device for transmission of the position of the moveable furniture part, that is detected by the detection device, to the locking element, and the locking element is moveable in dependence on the detected position. In that way, the position of the moveable furniture part is passed to the locking element in an uncomplicated fashion.

The detection device does not have to be connected to the locking element in every position. Rather, it can be provided that in the closed position, in the over-pressed closed position and in an open position which is at least directly in front of the closed position of the moveable furniture part, the detection device bears against the moveable furniture part or is connected to the moveable furniture part.

In order in a simple fashion to permit conversion of the pulling movement and the pushing movement into one and the same movement of the locking element, the transmission device can have a rotary element which can be held by at least one force storage means in a central position. Preferably, the detection device can engage the rotary element by way of an engagement element, and the rotary element can be rotatable out of the central position both upon movement of the engagement element in the opening direction and also in the closing direction. Preferably, the locking of the ejection element is nullified when the rotary element is outside the central position.

For a simplified design configuration of the ejection device, in accordance with a first embodiment of the present invention, the rotary element can be at the same time the locking element. More especially, the locking element can be connected by way of two tie bars to two springs forming the force storage means, in which the springs on the one hand are fixed to the housing and on the other hand are respectively fixed to an end of one of the two tie bars. The tie bars are limitedly moveable in slots in the housing, by way of guide elements. In addition, in that first embodiment, the rotary movement of the locking element is effected upon unlocking only in one direction, preferably in the clockwise direction, and the rotary movement is limited by virtue of the tie bars guided in the two slots by way of the guide elements.

In a second embodiment of the present invention, the locking element and the rotary element can be formed separately, and the locking element is acted upon by the force storage means and bears against the rotary element. To permit transmission of movement detection to the locking element, the locking element can bear against a V-shaped region of the rotary element wherein the rotary element is in the central position when the locking element bears against the point, that is closest to the axis of rotation, of the V-shaped region.

In principle, it is only necessary to guarantee in the closed position that the path of movement of the ejection element in the opening direction is blocked by the locking element. That can be effected, for example, by friction or clamping. It is preferably provided that the ejection element is held in the closed position on the locking element in positively locking relationship by a latching element connected to the ejection element.

To achieve easy clearance of the opening path of movement for the ejection element, the locking element is moveable transversely relative to the opening direction both upon over-pressing of the moveable furniture part from a closed position in the closing direction and also upon pulling of the moveable furniture part from the closed position in the opening direction.

An article of furniture can also include a moveable furniture part and a lockable ejection device according to the invention for the moveable furniture part.

BRIEF DESCRIPTION OF THE DRAWINGS

Further details and advantages of the present invention will be described more fully hereinafter by the specific description with reference to the embodiments by way of example illustrated in the drawings, in which.

DETAILED DESCRIPTION OF THE INVENTION

Figures 1, 2, 3, 4:
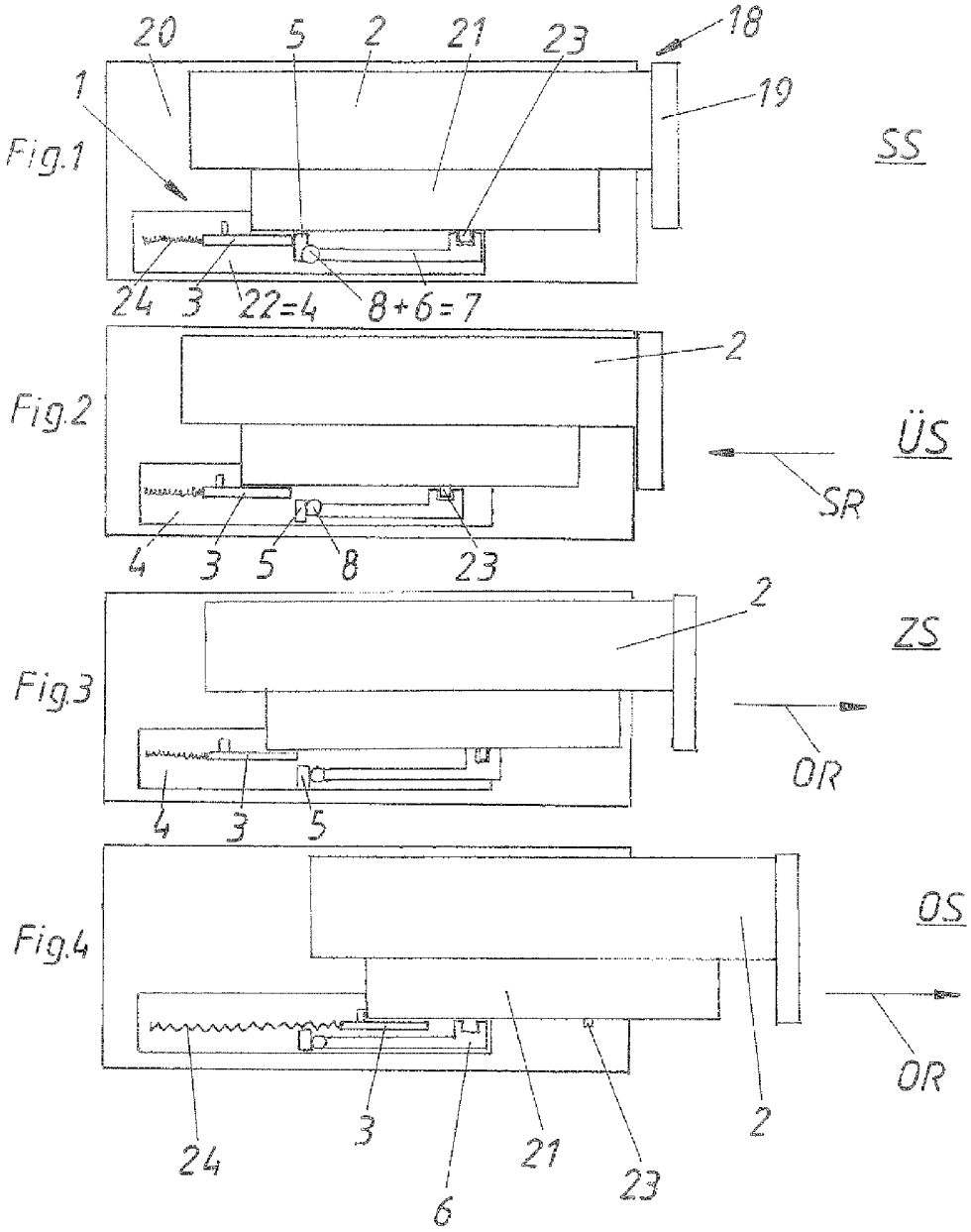
FIGS. 1 through 4 diagrammatically show an article of furniture having a moveable furniture part in various positions.

FIG. 1 shows an article of furniture 18 comprising a furniture carcass 20 and a furniture part 2 mounted moveably therein, the furniture part 2 being in the closed position SS. The moveable furniture part 2 is connected to the carcass rail 22 by way of a drawer rail 21 (optionally also by way of a central rail). In this diagrammatic view, the carcass rail 22 also forms the housing 4 of the lockable ejection device 1. That ejection device 1 has an ejection element 3 which is acted upon in the opening direction OR by an ejection force storage member 24. That ejection force storage member 24 is stressed in FIG. 1 as the path of movement of the ejection element 3 in the opening direction OR is blocked by the locking element 5. Fixed to the drawer rail 21 is an entrainment member 23 to which the locking element 5 is connected at least temporarily by a transmission device 7. The transmission device 7 includes on the one hand a detection device 6 for detecting the position of the entrainment member 23 and thus the moveable furniture part 2, as well as a rotary element 8.

If as shown in FIG. 2 a pressure is applied in the closing direction SR to the moveable furniture part 2, then the moveable furniture part 2 passes into the over-pressed closed position ÜS. With that movement, the entrainment member 23 and the detection device 6 are also moved in the closing direction SR so that the locking element 5 is moved transversely relative to the direction of movement of the moveable furniture part 2 by way of the rotary element 8, and so the path for the ejection element 3 in the opening direction OR is cleared.

In substantially the same manner, as shown in FIG. 3, unlocking of the locking element 5 is effected when pulling on the moveable furniture part 2 in the opening direction. As a result, the moveable furniture part 2 passes into an initial open position ZS (pulling position) which is immediately before the closed position SS in the opening direction OR.

As soon as the locking element 5 has released the ejection element 3—whether by pressing (see FIG. 2) or by pulling (see FIG. 3)—the ejection force storage member 24 can move in the opening direction OR as shown in FIG. 4 and in so doing can entrain or eject the moveable furniture part 2. In that case—as is known per se—the entrainment member 23 can go into a free-running mode by pivotal movement of the detection device 6. As a result, the moveable furniture part 2 is in the open position OS.

Figure 5:
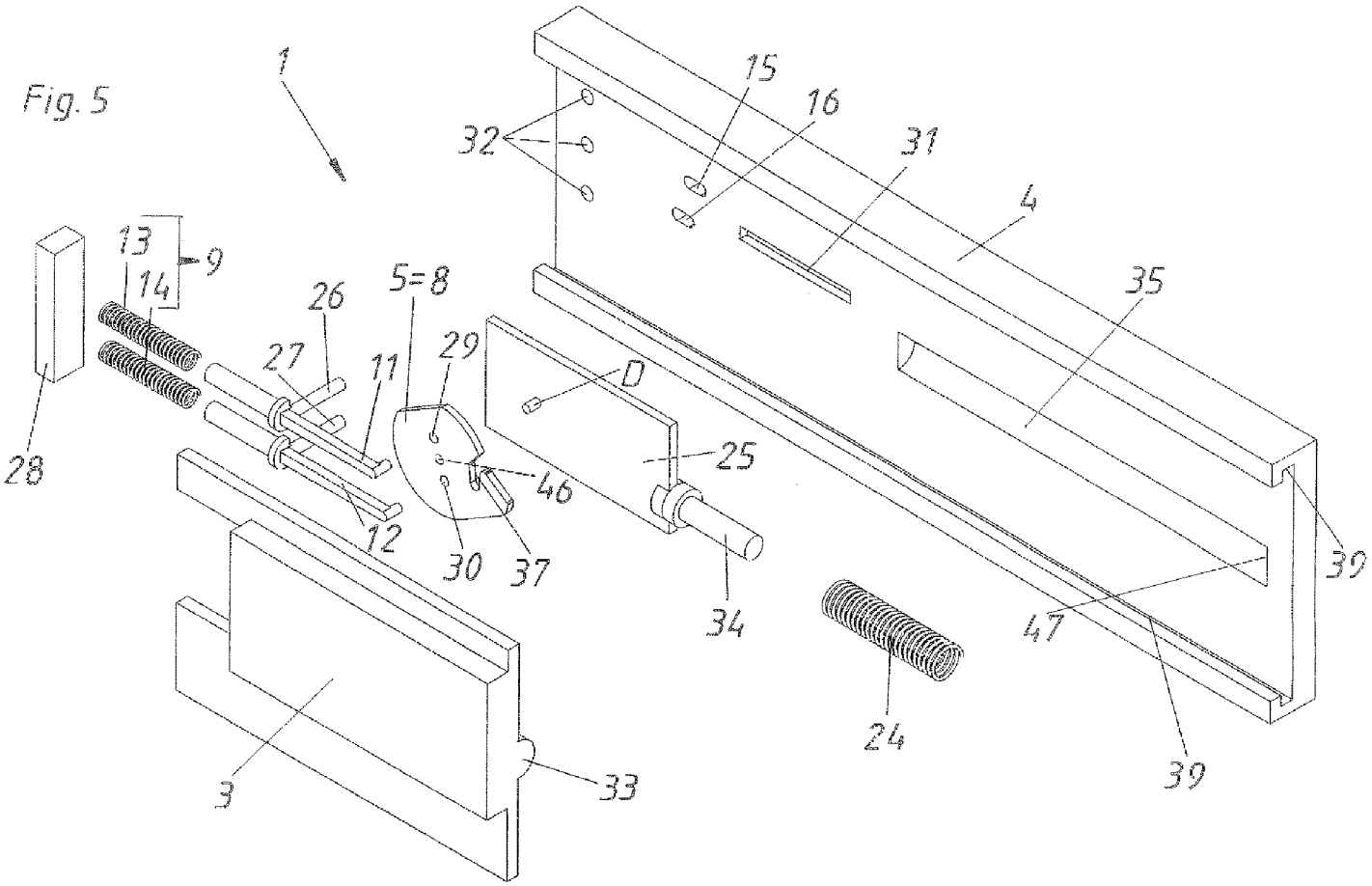
FIGS. 5 and 6 show exploded views of a first embodiment of a lockable ejection device.
Figure 6:
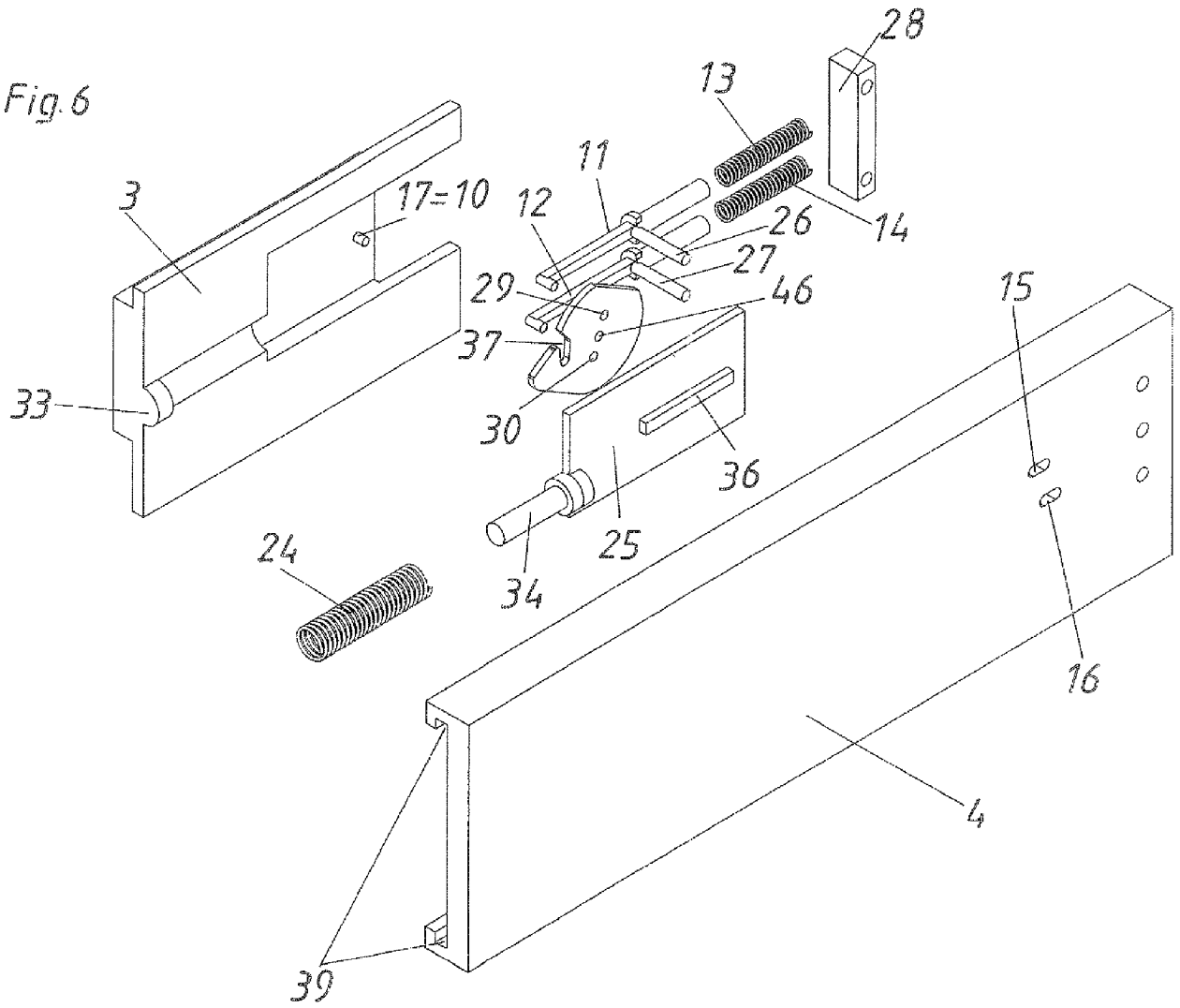

A first embodiment of the present invention is shown in FIGS. 5 through 13. The exploded views in FIGS. 5 and 6 show the housing 4 of the ejection device 1, the ejection element 3 being moveable along the guide tracks 39. That ejection element 3 is connected at least portion-wise to the moveable furniture part 2. The base element 25 is arranged displaceably along the guide track 31 between the ejection element 3 and the housing 4. The spring guide 34 for the ejection force storage member 24 is also arranged on the base element 25. The spring bases for the ejection force storage member 24 are formed on the one hand by the thicker end region of the spring guide 34 and on the other hand the abutment 33 on the ejection element 3. The axis of rotation D for the rotary element 8 is provided on the base element 25 by a pin. In this first embodiment, the rotary element 8 at the same time forms the locking element 5, and the locking region 37 for a latching element 17 (shown in FIG. 6) is provided in the locking element 5. The two tie bars 11 and 12 engage the locking element 5. A tie bar 11 engages by way of its pin-shaped end into the connecting hole 29 in the locking element 5. In addition, the tie bar 11 is guided displaceably by the guide element 26 in the slot 15 in the housing 4. The tie bar 11 is further supported in spring-loaded relationship against the abutment 28 by the first spring 13 forming the force storage member 9. That abutment 28 is fixedly connected to the housing 4 by the fixing regions 32. In the same way, the tie bar 12 is held by its pin-shaped front end in the connecting hole 30 in the locking element 5. The guide element 27 of the tie bar 12 is also guided displaceably in the lower slot 16. In addition, the tie bar 12 is spring-loaded by the second spring 14 which also forms the force storage member 9. The rotary element 8 or the locking element 5 is rotatably connected by the connecting hole 46 to the pin-shaped axis of rotation D of the base element 25. It will also be seen from the exploded view in FIG. 6 that the base element 25 has a guide limb 36 which engages into the guide track 31 in the housing 4. The guide limb 36 in this case is slightly shorter than the guide track 31 so that the base element 25 can also perform the over-pressing movement and the pulling movement. The ejection element 3 is displaceable limitedly by the abutment 33 in the spring guide track 35 of the housing 4. In that case, the ejection element 3 can be moved in the opening direction OR as far as the abutment 47, while on the other hand the ejection element 3 can be moved in the closing direction SR until the ejection force storage member 24 is completely stressed or until the condition of abutment against the spring guide 34 occurs.

Figure 7:
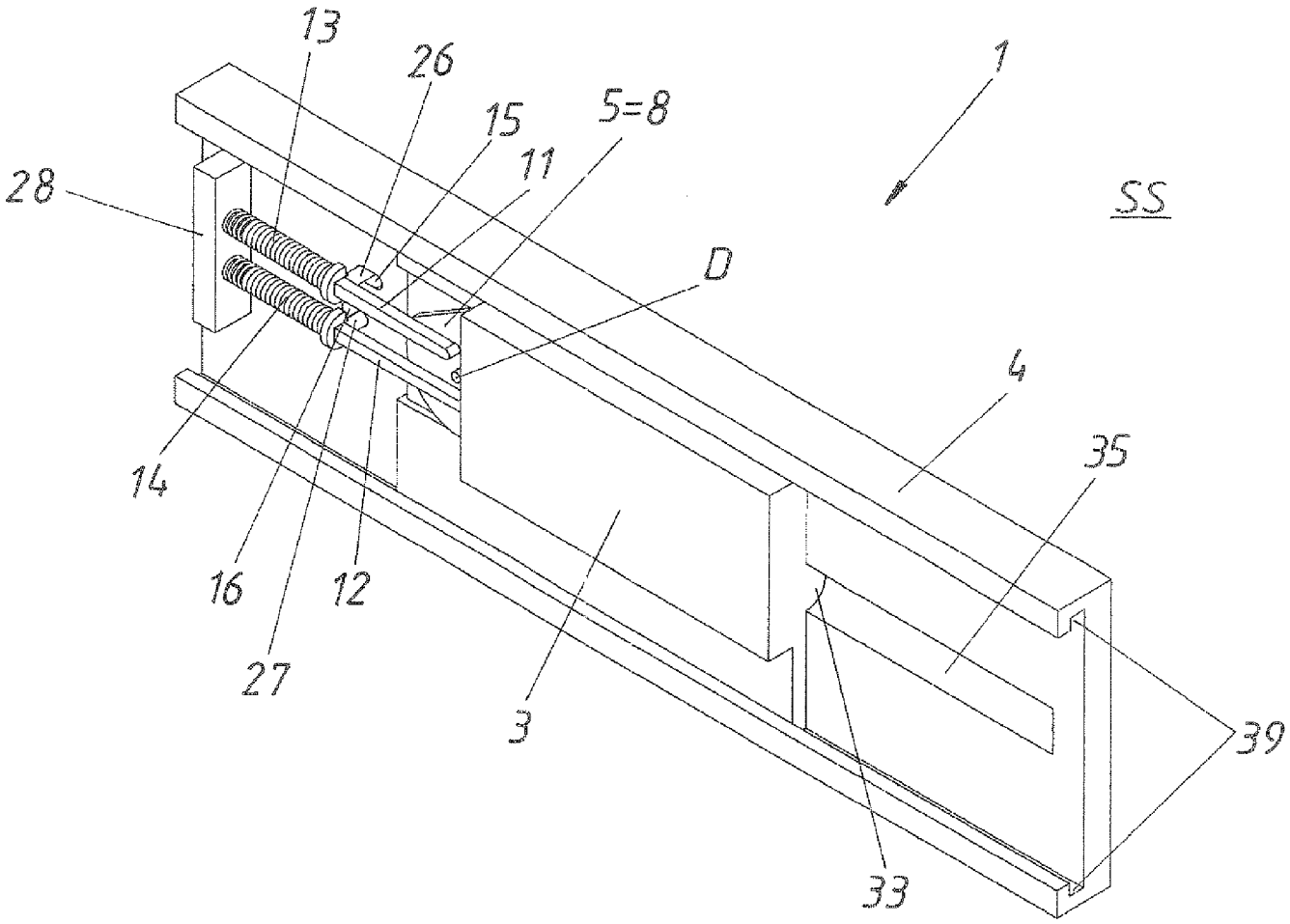
FIG. 7 shows the lockable ejection device in the assembled condition.

FIG. 7 shows the ejection device 1 in the assembled condition, with the abutment 33 projecting into the spring guide track 35. In addition, the two guide elements 26, 27 project into the corresponding slots 15 and 16. The entire lockable ejection device 1 is disposed in the closed position SS.

Figure 8:
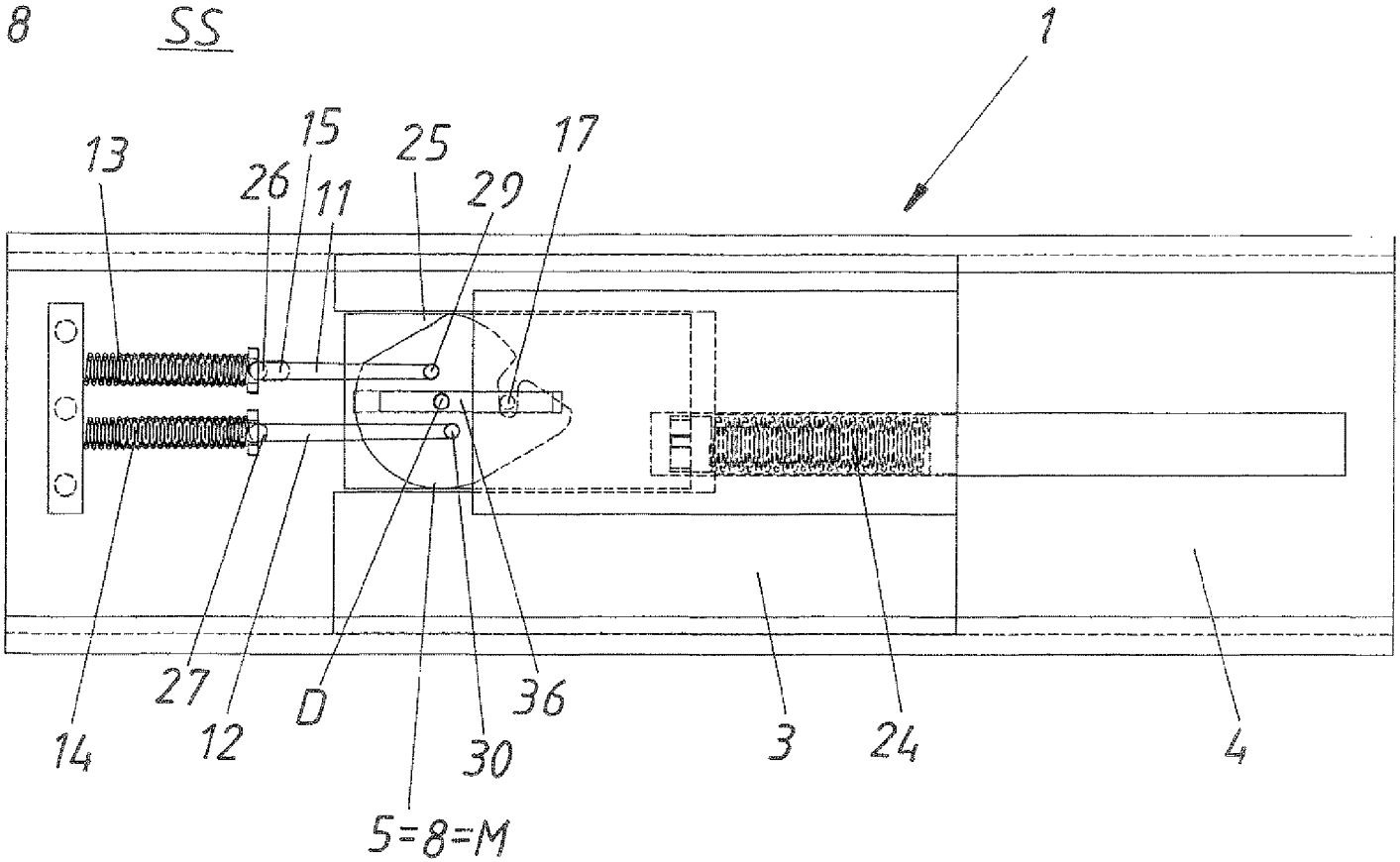
FIGS. 8 through 13 show views of the ejection device in various positions.

In conformity therewith, FIG. 8 also shows the lockable ejection device 1 in the closed position SS. As the two springs 13 and 14 which are in the form of compression springs are of equal strength, the locking element (rotary element 8) is also disposed in the central position M. In that case, the guide element 27 bears against the right-hand end of the slot 16 which is displaced somewhat towards the left and cannot move further in the opening direction OR. As the spring 13 is of the same strength, the guide element 26 remains at the left-hand end of the slot 15 which is further displaced towards the right. The latching element 17 arranged on the ejection element 3 is held in the locking region 37 of the locking element 5. The path of movement of the latching element 17 in the opening direction OR is thus blocked by the locking element 5.

Figure 9:
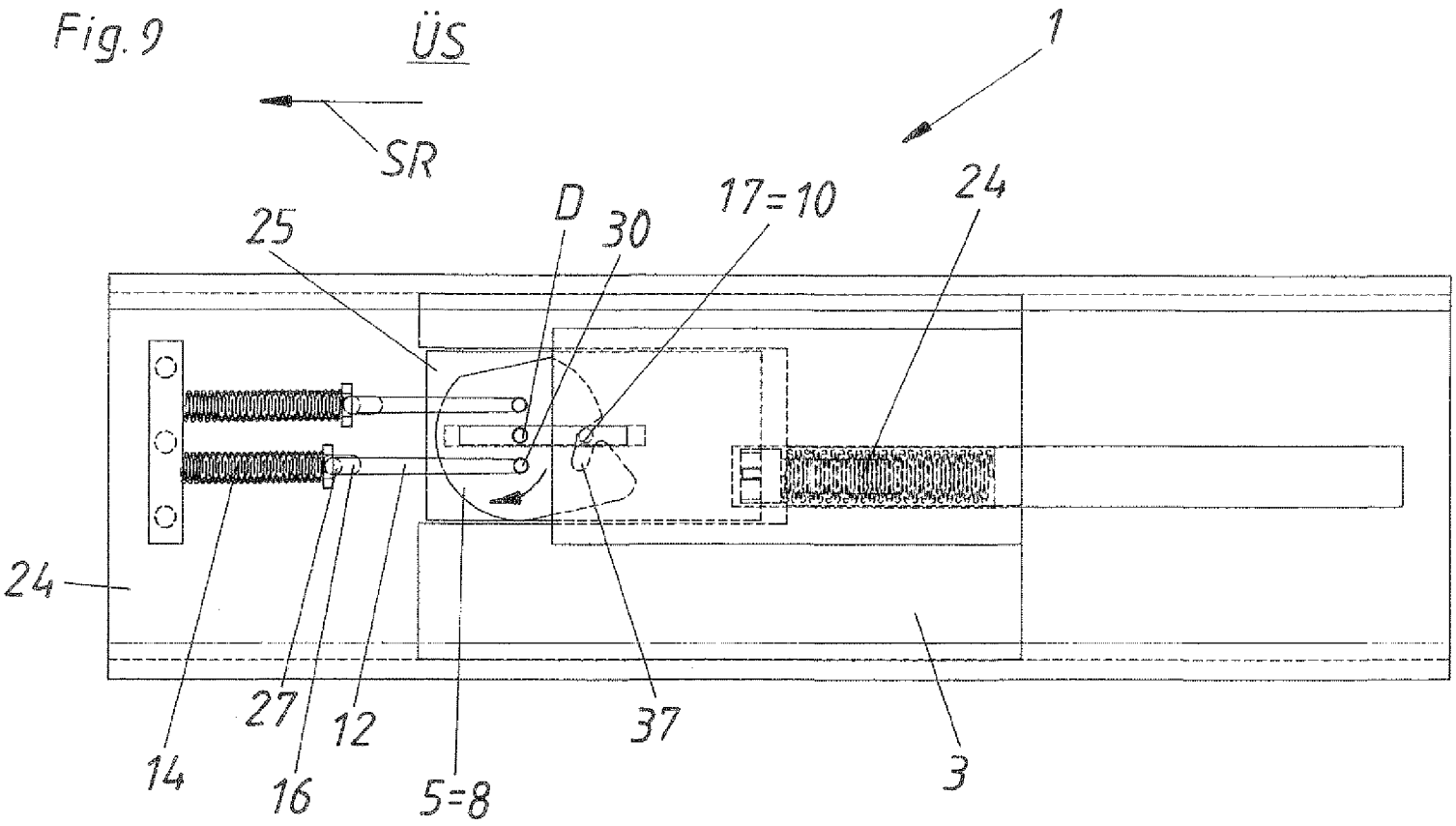

If, starting from that closed position SS, pressure is applied to the moveable furniture part 2 in the closing direction SR, the lockable ejection device 1 passes into the over-pressed closed position ÜS as shown in FIG. 9. In that case, the position of the moveable furniture part 2 is passed on by way of a detection device 6 (not shown) and the ejection element 3 (which together with the engagement element 10 formed by the latching element 17 forms the transmission device 7) moves the locking element 5 towards the left relative to the housing 4. As, by virtue of the guide element 26 which butts against the slot 15 at the left, the upper tie bar 11 cannot move further towards the left, the rotary element 8 necessarily rotates in the clockwise direction until the guide element 27 of the tie bar 12 has moved against the force of the second spring 14 until reaching the left-hand abutment of the slot 16. At the same time, the axis of rotation D also moves by half the distance relative to the housing 4. Due to that rotation of the rotary element 8, the locking region 37 also pivots, whereby the latching element 17—which applied the over-pressing movement to the locking element 5—is released and is thus no longer blocked by the locking element 5.

Figure 10:
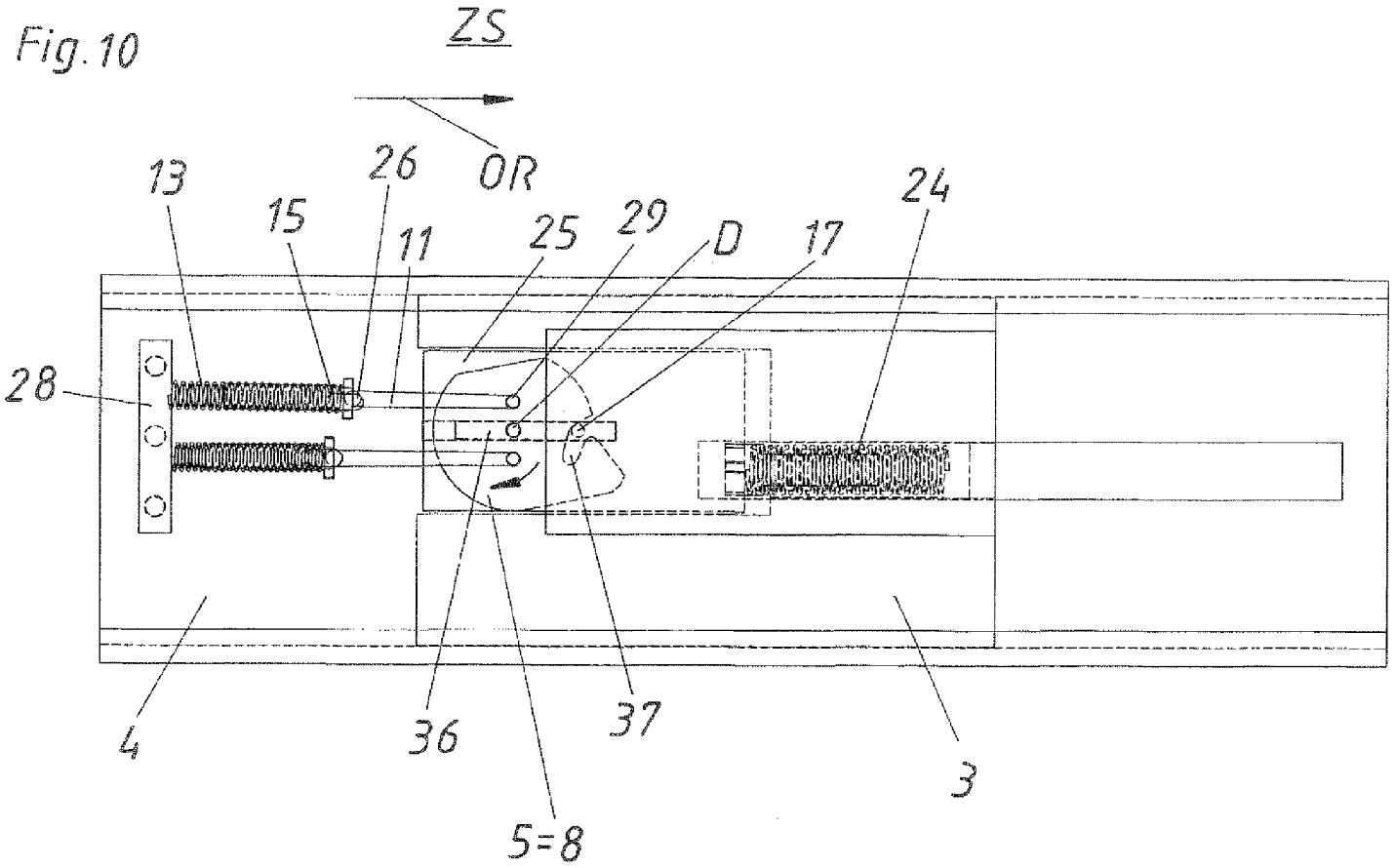

The same unlocking effect is also achieved when pulling on the moveable furniture part 2 as shown in FIG. 10. When the moveable furniture part 2 is pulled, the ejection element 3 and therewith the latching element 17 are moved in the opening direction OR and pass into the open position ZS which is directly in front of the closed position SS. The rotary element 8 is moved towards the right in the opening direction OR by the latching element 17 which at the same time forms the engagement element 10. The lower tie bar 12 cannot be further moved in the opening direction OR by virtue of the guide element 27 disposed at the right-hand abutment end of the slot 16. In contrast, the tie bar 11 can be further moved in the opening direction OR with its guide element 26 in the upper slot 15, whereby in turn a rotary movement of the locking element 5 or the rotary element 8 about the axis of rotation D in the clockwise direction is triggered. The axis of rotation D moves approximately half as far as the connecting slot 29 relative to the housing 4 in the opening direction OR until the spring limb 36 bears against an end of the guide track 31. Due to the rotation of the locking element 5 in the clockwise direction, the latching element 17 in this FIG. 10 also passes outside the locking region 37 of the locking element 5.

Figure 11:
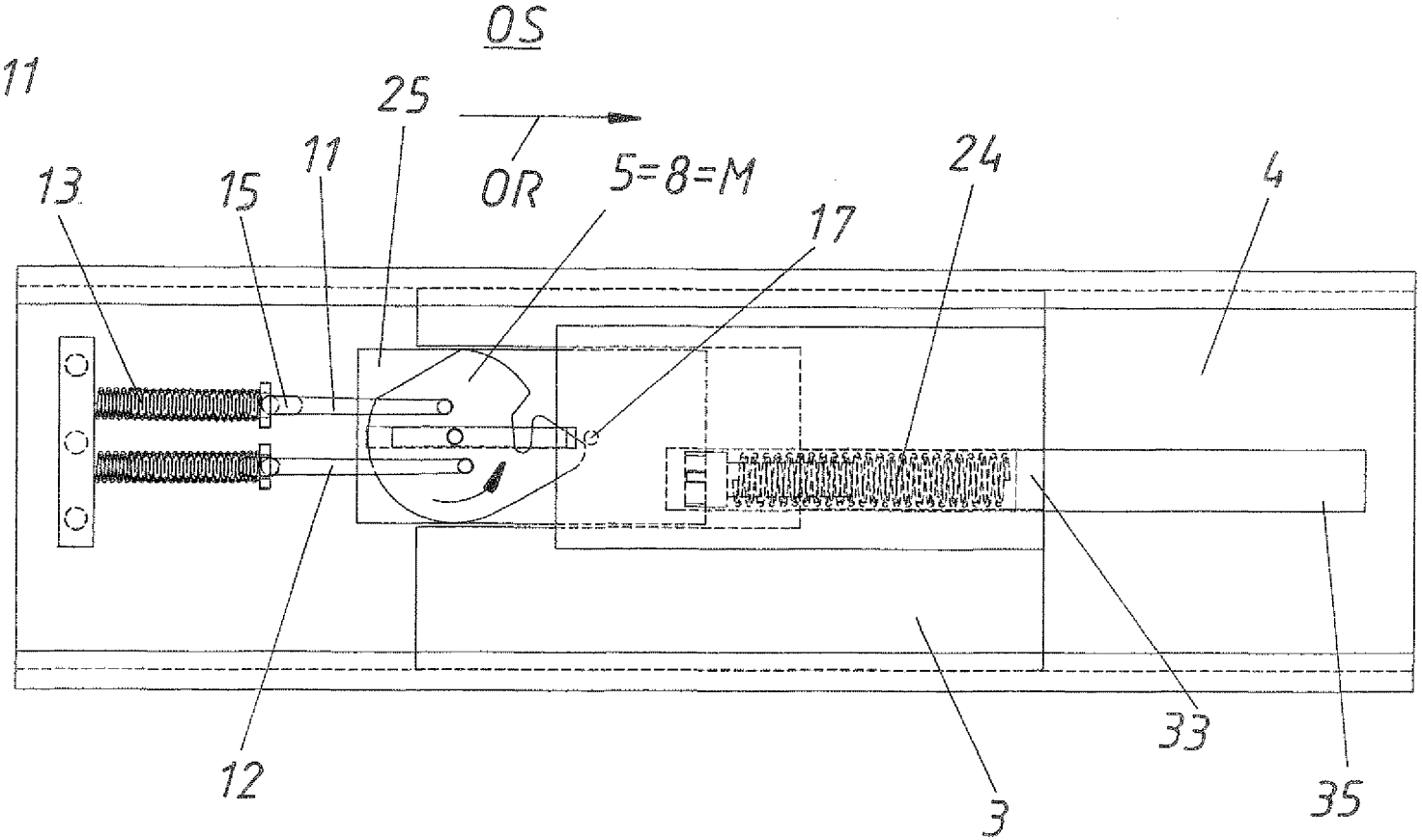

By virtue of that unlocking action, as shown in FIG. 11, the ejection force storage member 24 can be relieved of stress and moves the ejection element 3 and therewith, by way of a connecting device (not shown), the moveable furniture part 2, in the opening direction OR. As soon as the latching element 17 is no longer in contact with the locking element 5, a respective one of the springs 13 or 14 moves again into the starting position so that the rotary element 8 again moves in the counter-clockwise direction into the starting position or central position M as shown in FIG. 11.

Figure 12:
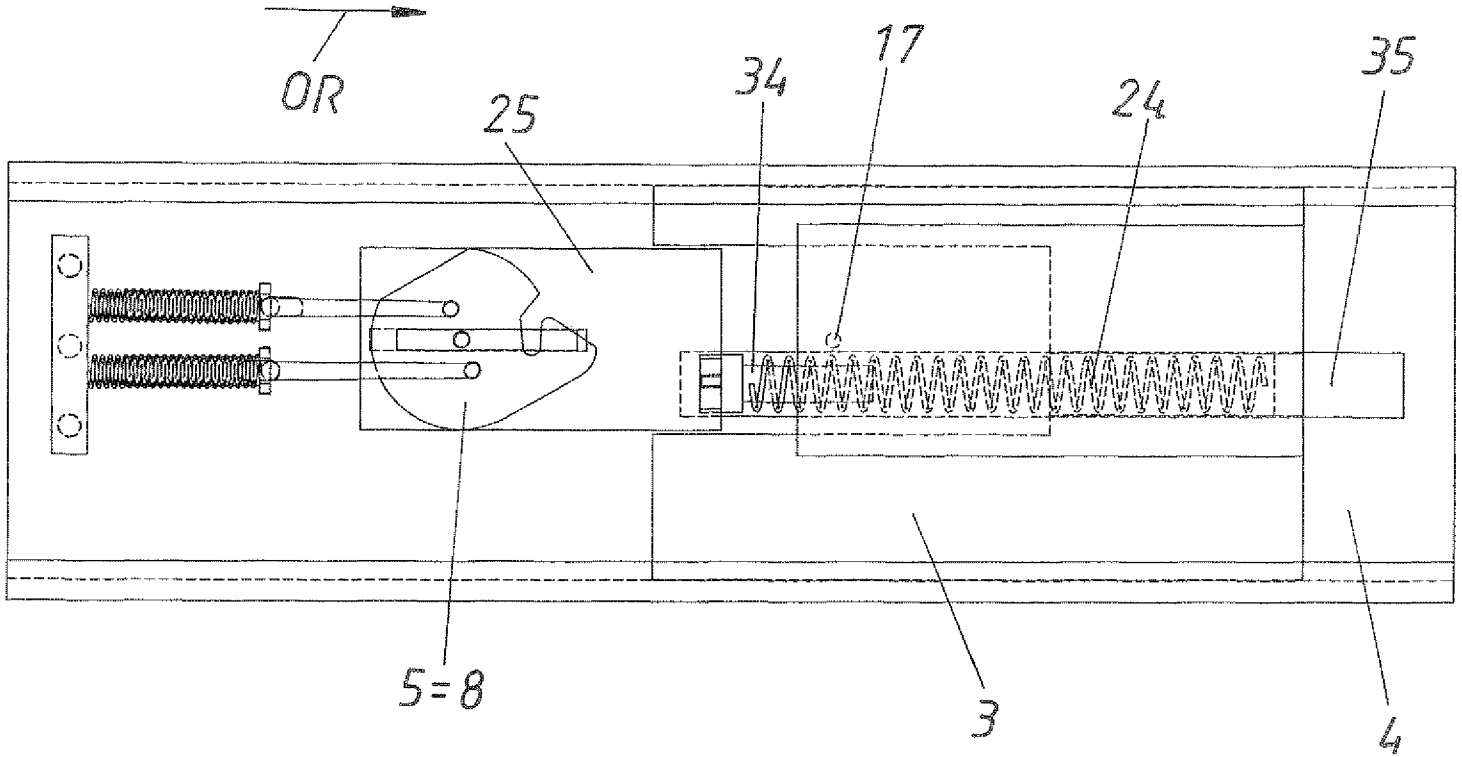
Figure 13:
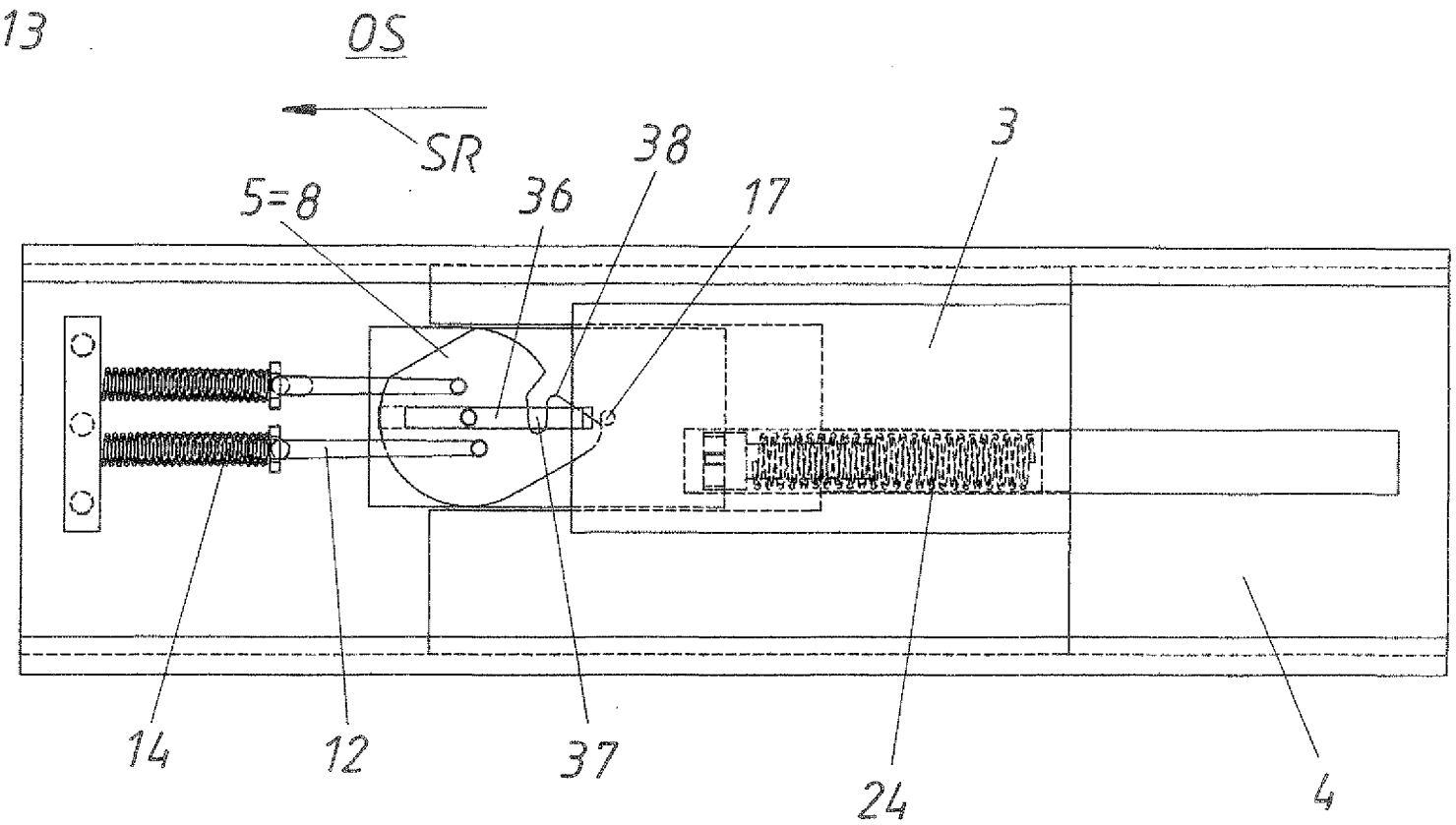
Figure 15:
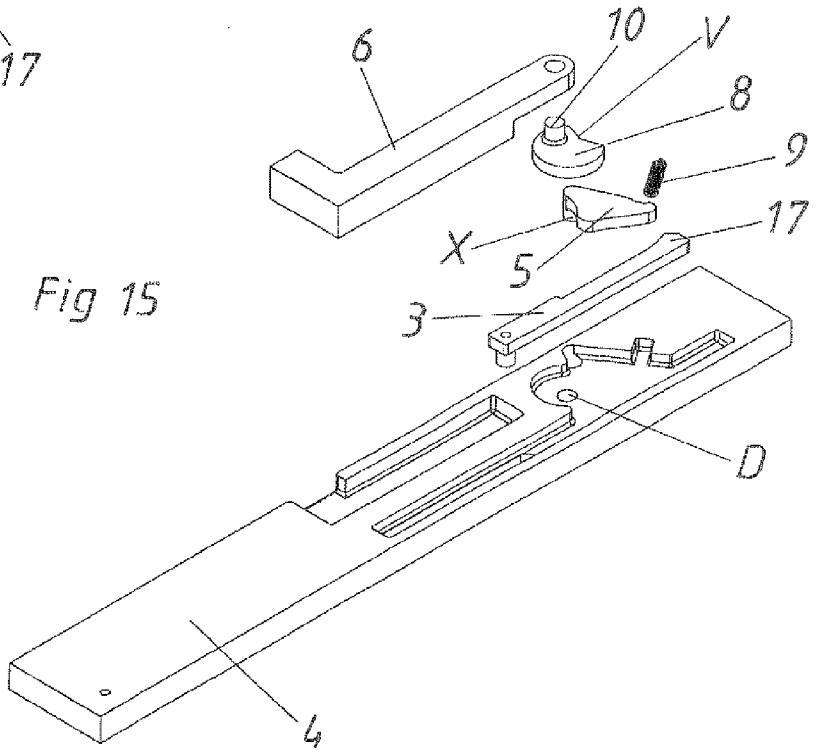
FIG. 15 shows an exploded view of FIG. 14, FIGS. 16 through 20 show views of various position of the ejection device according to the second embodiment.
Figure 14:
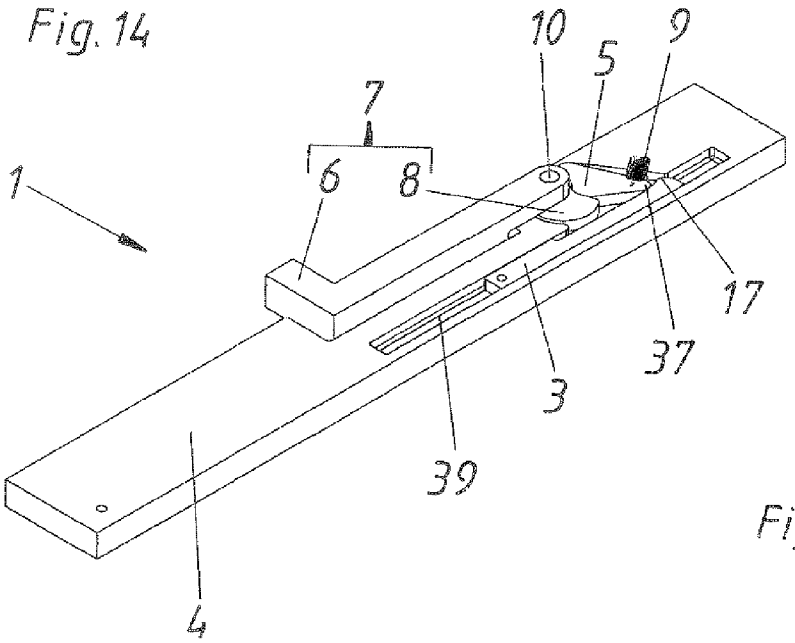
FIG. 14 shows a second embodiment of a lockable ejection device.

As shown in FIG. 12, the ejection force storage member 24 has been further relieved of stress and the arrangement has reached a further open position OS of the ejection device or the moveable furniture part 2.

When the moveable furniture part 2 is closed again the ejection force storage member 24 is again stressed by a movement of the ejection element 3 in the closing direction SR. In the last part of the closing portion (see FIG. 13), the latching element 17 comes into contact with the locking element 5. Upon further closing movement, the latching element 17 presses against the inclined run-on portion 38 and rotates the locking element 5 about the axis of rotation D against the force of the spring 14 until the latching element 17 is locked or snaps into place in the locking region 37. The starting position (closed position SS) as shown in FIG. 8 is thus restored.

FIGS. 14 through 20 show a further embodiment of the present invention, wherein the rotary element 8 and the locking element 5 are in the form of separate components. Once again, the ejection element 3 is mounted displaceably on the housing 4 along a guide track 39. That ejection element 3 is held by the locking element 5 by a widened end region which forms the latching element 17. The locking element 5 is again mounted on the housing 4 rotatably about the axis of rotation X and is acted upon a force storage member 9 supported on the housing 4. In addition, a rotary element 8 is mounted rotatably to the housing 4 by the axis of rotation D. Outside the rotary point of that rotary element 8 is the engagement element 10 to which the detection device 6 is connected. The detection device 6, the engagement element 10, and the rotary element 8 jointly form the transmission device 7 for transmission of the position of the moveable furniture part 2 to the locking element 5. More specifically, that position is passed on to the locking element 5 by way of the V-shaped region V of the rotary element 8.

In a corresponding fashion, FIG. 16 shows the closed position SS in which the locking element 5 bears against the point P, which is closest to the axis of rotation, of the V-shaped region V of the rotary element 8 and thus the rotary element 8 is in the central position M. In this case, the force storage member 9 is at least somewhat relieved of stress so that the locking region 37 of the locking element 5 blocks the path of movement of the ejection element 3 in the opening direction OR. That is achieved by the widened end of the ejection element 3, that thus forms the latching element 17.

If now as shown in FIG. 17 pressure is applied to the moveable furniture part 2 towards the right in the closing direction SR the detection device 6 and therewith the engagement element 10 also move towards the right. As the engagement element 10 eccentrically engages the rotary element 8, it rotates in the clockwise direction whereby the locking element 5 can no longer bear against the point P, closest to the axis of rotation, of the V-shaped region V and is pivoted against the force of the force storage means 9 in the counter-clockwise direction. As a result, the locking region 37 no longer blocks the latching element 17 whereby the ejection element 3 is released or unlocked.

When a pulling force is applied to the moveable furniture part 2 in the opening direction OR, the detection device 6 together with the engagement element 10 also moves towards the left in the opening direction OR (see FIG. 18). As a result, the rotary element 8 rotates out of its central position M in the counter-clockwise direction and the locking element 5 in turn no longer bears against the point P, closest to the axis of rotation, of the V-shaped region V. The locking element 5, however, is in turn pivoted in the counter-clockwise direction with stressing of the force storage member 9 whereby the ejection element 3 is again released.

As soon as the over-pressed closed position ÜS (FIG. 17) or the open position ZS immediately before the closed position SS (FIG. 18) is reached, the ejection force storage member 24 (not shown in this embodiment) can move the ejection element 3 in the opening direction OR, as shown in FIG. 19. As soon as the moveable furniture part 2 reaches the open position OS or as soon as the detection device 6 is free, the force storage member 9 can be relieved of stress again and by way of the locking element 5 moves the rotary element 8 into its central position M again.

Upon closure the ejection force storage member 24 (not shown) is stressed again and moves the ejection element 3 in the closing direction SR as shown in FIG. 20. By way of the inclined run-on portion 38 the ejection element 3 pivots the locking element 5 against the force of the force storage member 9 just before the closed position SS is reached. As soon the thickest point of the ejection element 3 has been passed, the latching element 17 of the ejection element 3 is again held in partly frictional locking relationship and partly in positively locking relationship by the locking region 37 of the locking element 5.

Figure 22:
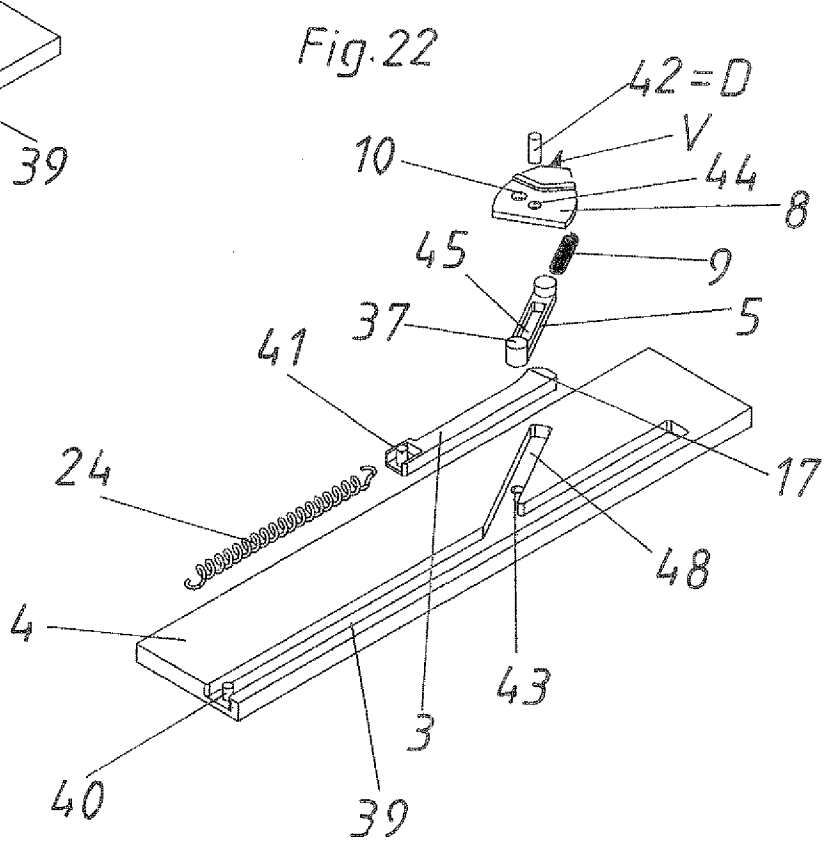
FIG. 22 shows an exploded view of FIG. 21, and FIGS. 23 through 27 show views of various positions of the ejection device according to the third embodiment.
Figure 21:
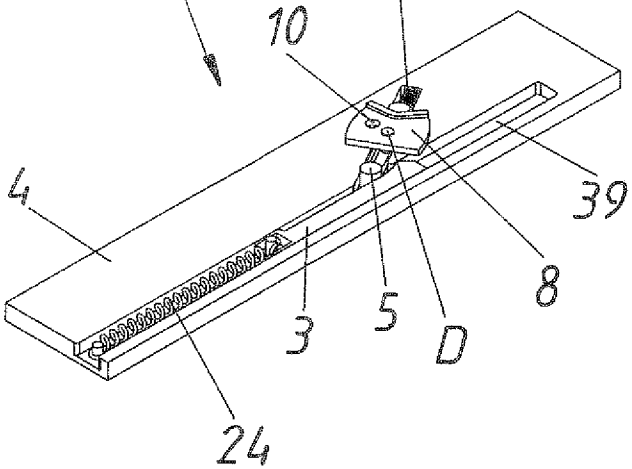
FIG. 21 shows a third embodiment of a lockable ejection device.

A third embodiment of a lockable ejection device 1 is shown in FIGS. 21 through 27. Referring to FIGS. 21 and 22 this ejection device 1 has a housing 4, the ejection element 3 being mounted displaceably in a guide track 39 of the housing 4. The ejection force storage member 34 which is in the form of a tension spring is clamped between the spring base 40 on the housing 4 and the spring base 41 on the ejection element 3. A widened end of the ejection element 3 again forms the latching element 17. In this third embodiment, the locking element 5 is not rotatable but is mounted slidably in a track 48 of the housing 4. At the end of the track 48, the locking element 5 is acted upon by a force storage member 9 (compression spring). The locking element 5 has a slot 45. The locking region 37 is arranged at the end of the locking element 5, being the end facing in the direction of the guide track 39. Provided in the housing 4 is a pin receiving portion 43 for receiving the pin 42, the pin 42 at the same time forming the axis of rotation D for the rotary element 8 and projecting through the slot 45. The pin 42 is connected to the rotary element 8 by the pin receiving portion 44. The rotary element 8 additionally has a V-shaped region V against which the rear end of the locking element 5 bears. In addition, provided eccentrically in the rotary element 8 is an opening which forms the engagement element 10 for a transmission device 7 which is not shown in greater detail in this third embodiment.

Figure 23:
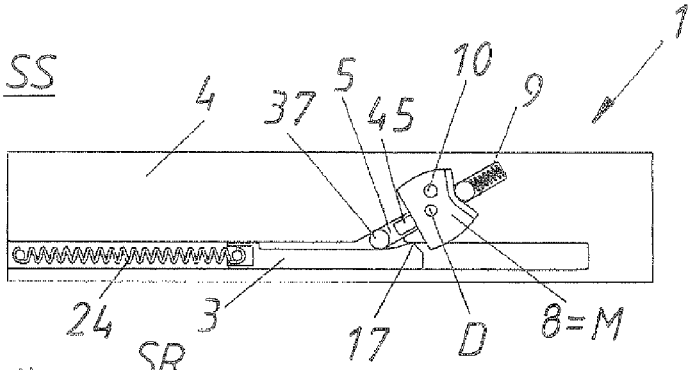

Referring to FIG. 23, the lockable ejection device 1 is in the closed position SS. In this case, the force storage member 9 is substantially relieved of stress and the locking region 37 of the locking element 35 blocks the path of travel for the ejection element 3 in the opening direction OR. The ejection force storage member 24 which is in the form of a tension spring is stressed. The rotary element 8 is in the central position M, the rear end of the locking element 5 bearing against the point P, closest to the axis of rotation, of the V-shaped region V of the rotary element 8.

Figure 24:
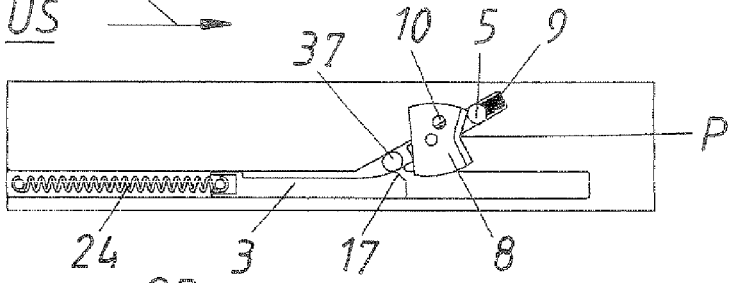

As soon as the engagement element 10 is also moved in the closing direction SR by way of the transmission device 7 (not shown), upon over-pressing of the moveable furniture part 2 in the closing direction SR into the over-pressed closed position ÜS, the rotary element 8 rotates in the clockwise direction about the axis of rotation D whereby the rear end of the locking element 5 is displaced rearwardly against the force of the force storage member 9 (see FIG. 24). That is achieved by the rotary element 8 being moved out of the central position M and the rear end of the locking element 5 therefore no longer bearing against the point P. At the same time, the locking region 37 also moves back and clears the path of movement for the latching element 17 and the ejection element 3 in the opening direction OR.

Figure 25:
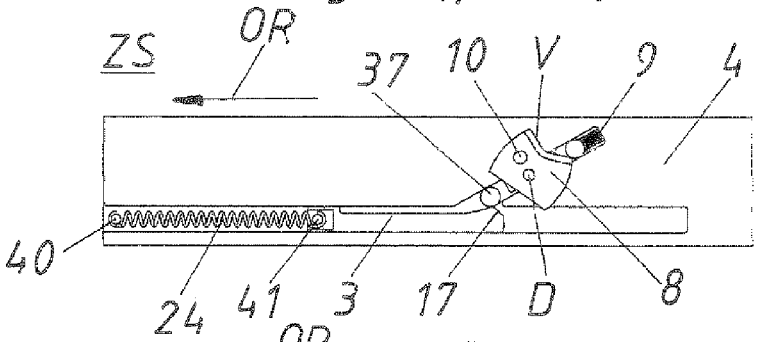

When a pulling force is applied to the moveable furniture part 2 in the opening direction OR, the engagement element 10 also moves in the opening direction OR and thereby rotates the rotary element 8 in this case in the counter-clockwise direction (see FIG. 25). As a result, the locking element 5 is again displaced against the force of the force storage member 9 whereby the locking region 37 releases the latching element 17 and thus the ejection element 3.

Figure 26:
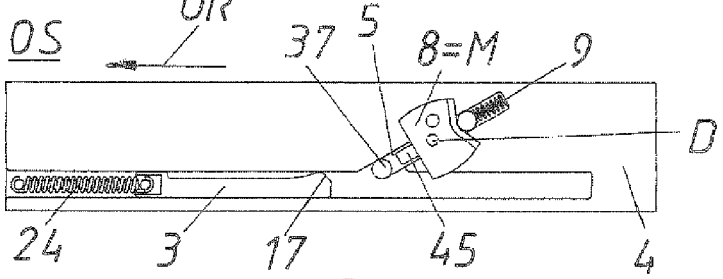
Figure 27:
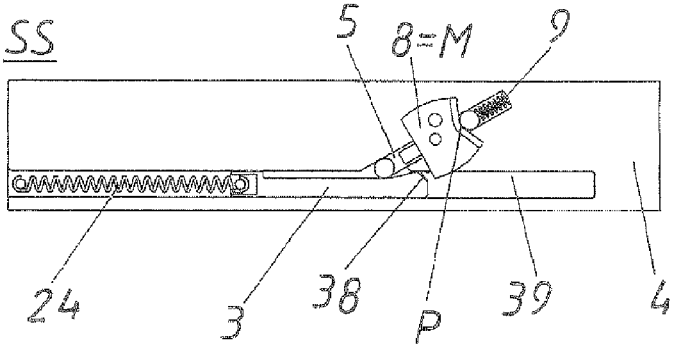

By virtue of that release or unlocking the ejection force storage member 24 can be relieved of stress and moves the ejection element 3 in the opening direction OR into the open position OS as shown in FIG. 26. As soon as force is no longer applied to the engagement element 10, the force storage member 9 can be relieved of stress again and the rotary element 8 passes into the central position M.

Upon closure of the moveable furniture part 2, the ejection element 3 again moves past the locking region 37 of the locking element 5 by way of the inclined run-on portion 38, whereupon the ejection element 3 is again held partly in frictionally locking relationship and partly in positively locking relationship at the locking region 37. The friction between the ejection element 3 and the locking region 37, by virtue of the ejection force storage member 24, must be greater than the spring force of the force storage member 9.

Thus, the present invention discloses a configuration of the locking element 5, that is an alternative to the previous lockable ejection devices 1. The ejection element 3 is unlockable by a relative movement of the locking element 5 with respect to the housing 4 both upon over-pressing of the moveable furniture part 2 and also when the moveable furniture part 2 is pulled.

It will be appreciated that, in principle, adaptations are possible in the entire arrangement while retaining the basic concept. Thus, for example, the entire ejection device 1 can also be arranged on the moveable furniture part 2 and can bear against an entrainment member 23 fixed with respect to the carcass.

In principle, it is also possible for a preferably damped retraction device also to be provided in addition to the ejection element 3, with which retraction device the furniture part 2 is gently pulled into the closed position. In terms of structure that can be integrated into the entire construction or it can also be formed separately. The housing 4 does not have to be interpreted as an enclosing housing but rather can also be in the form of a simple mounting plate on which the essential components of the lockable ejection device 1 are arranged.

The invention claimed is:

1. A lockable ejection device for a moveable furniture part, said lockable ejection device comprising:

an ejection element configured to act on the moveable furniture part in an opening direction;

a housing;

a locking element arranged in or on said housing, said locking element configured to block a path of said ejection element in the opening direction at least in a closed position of the moveable furniture part;

a detection device for detecting a position of the moveable furniture part;

a transmission device for transmitting the detected position of the moveable furniture part to said locking element, said locking element being moveable based on the detected position, and said transmission device including a rotary element; and a force storage member for holding said rotary element in a central position;

wherein said locking element is further configured to release said ejection element upon both an over-pressing of the moveable furniture part from the closed position in a closing direction and also upon pulling of the moveable furniture part from the closed position in the opening direction; and wherein said locking element is further configured to unlock said ejection element by a movement of said locking element relative to said housing upon both the over-pressing of the moveable furniture part and also upon the pulling of the moveable furniture part.

2. The ejection device as set forth in claim 1, wherein said detection device is configured to bear against the moveable furniture part or is connected to the moveable furniture part in the closed position, in the over-pressed closed position, and in an open position at least directly in front of the closed position of the moveable furniture part.

3. The ejection device as set forth in claim 1, wherein said detection device is configured to engage said rotary element via an engagement element, said rotary element is configured to rotate out of the central position both upon movement of said engagement element in the opening direction and also upon movement of said engagement element in the closing direction.

4. The ejection device as set forth in claim 1, wherein said rotary element nullifies locking of said ejection element when said rotary element is outside the central position.

5. The ejection device as set forth in claim 1, wherein said rotary element is also said locking element.

6. The ejection device as set forth in claim 5, wherein said locking element is connected by two tie bars to two springs forming said force storage member, said two springs each having a first end fixed to said housing and having a second end fixed to an end of a respective one of said two tie bars, said two tie bars being limitedly moveable within respective slots in said housing.

7. The ejection device as set forth in claim 6, wherein said locking element is configured such that rotary movement of said locking element is effected upon unlocking only in one direction, said rotary movement being limited by said two tie bars guided within said respective slots by guide elements.

8. The ejection device as set forth in claim 6, wherein said locking element is configured such that rotary movement of said locking element is effected upon unlocking only in a clockwise direction.

9. The ejection device as set forth in claim 1, wherein said locking element and said rotary element are formed separately, said locking element being acted upon by a force storage member and bearing against said rotary element.

10. The ejection device as set forth in claim 9, wherein said locking element is configured to bear against a V-shaped region of said rotary element, said rotary element being configured so as to be located in the central position when said locking element bears against a point of said V-shaped region closest to an axis of rotation.

11. The ejection device as set forth in claim 1, further comprising a latching element for holding said ejection element in the closed position on said locking element in a positive locking relationship.

12. The ejection device as set forth in claim 1, wherein said locking element is moveable transversely relative to the opening direction both upon over-pressing of the moveable furniture part from the closed position in the closing direction and also upon pulling of the moveable furniture part from the closed position in the opening direction.

13. An article of furniture comprising:

a moveable furniture part; and a lockable ejection device as set forth in claim 1 for locking and ejecting said moveable furniture part.

* * * * *